US009780502B2

(12) United States Patent
Nuetzel et al.

(10) Patent No.: US 9,780,502 B2
(45) Date of Patent: Oct. 3, 2017

(54) ELECTRICAL PLUG CONNECTOR FOR A SAFETY RESTRAINT SYSTEM

(71) Applicant: DELPHI INTERNATIONAL OPERATIONS LUXEMBOURG S.A.R.L., Bascharage (LU)

(72) Inventors: Peter Nuetzel, Oberasbach (DE); Michael Gunreben, Schwanstetten (DE); Vincent Regnier, Spardorf (DE); Frank Odoerfer, Rothenbach an der Pegnitz (DE)

(73) Assignee: DELPHIA INTERNATIONAL OPERATIONS LUXEMBOURG S.A.R.L., Luxembourg (LU)

( * ) Notice: Subject to any disclaimer, the term of this patent is extended or adjusted under 35 U.S.C. 154(b) by 0 days.

(21) Appl. No.: 15/208,822

(22) Filed: Jul. 13, 2016

(65) Prior Publication Data

US 2017/0018889 A1 Jan. 19, 2017

(30) Foreign Application Priority Data

Jul. 15, 2015 (EP) ..... 15176757

(51) Int. Cl.

| | |
|---|---|
| ***H01R 29/00*** | (2006.01) |
| ***H01R 13/71*** | (2006.01) |
| ***H01R 13/641*** | (2006.01) |
| ***H01R 13/703*** | (2006.01) |
| ***H01R 13/642*** | (2006.01) |

(52) U.S. Cl.

CPC ..... *H01R 13/71* (2013.01); *H01R 13/641* (2013.01); *H01R 13/642* (2013.01); *H01R 13/7033* (2013.01)

(58) Field of Classification Search

CPC .... H01R 13/71; H01R 13/642; H01R 13/641; H01R 13/7033

USPC ..... 439/188

See application file for complete search history.

(56) References Cited

U.S. PATENT DOCUMENTS

| | | | | |
|---|---|---|---|---|
| 5,277,607 | A | 1/1994 | Thumma et al. | |
| 6,764,345 | B1 | 7/2004 | Duesterhoeft et al. | |
| 9,054,457 | B2 * | 6/2015 | Odorfer | F42B 3/26 |

FOREIGN PATENT DOCUMENTS

| | | | |
|---|---|---|---|
| DE | 102009053052 | A1 | 5/2011 |
| EP | 1115181 | A1 | 7/2001 |

(Continued)

OTHER PUBLICATIONS

Machine translation of DE 10 2009 053052.*

*Primary Examiner* — Javaid Nasri

(74) *Attorney, Agent, or Firm* — Robert J. Myers

(57) ABSTRACT

The present invention relates to an electrical plug connector for a safety restraint system, preferably for an airbag ignition system. The plug connector includes at least two contact terminals assigned to the plug connector and a shorting clip that is configured to short-circuit the at least two contact terminals in an uncoupled or incorrectly coupled condition of the plug connector. The shorting clip includes at least two contact blades. Each contact blade is electrically connected with one of the at least two contact terminals. Each of the contact blades includes at least one cutting edge. The cutting edges contact each other such that one edge cuts the other when the plug connector is in an uncoupled or incorrectly coupled condition.

15 Claims, 4 Drawing Sheets

(56) References Cited

FOREIGN PATENT DOCUMENTS

| | | | |
|---|---|---|---|
| WO | 2004020933 | A1 | 3/2004 |
| WO | 2010143078 | A2 | 12/2010 |

* cited by examiner

ELECTRICAL PLUG CONNECTOR FOR A SAFETY RESTRAINT SYSTEM

CROSS-REFERENCE TO RELATED APPLICATION

This application claims the benefit under 35 U.S.C. §119 (a) of Patent Application No. 15176757.1 filed in the European Patent Office (EPO) on Jul. 15, 2015, the entire disclosure of which is hereby incorporated by reference.

TECHNICAL FIELD OF THE INVENTION

The invention relates to an electrical plug connector for a safety restraint system, preferably for an airbag ignition system and in particular to plug connectors including at least two terminals, with which it is possible to electrically or electronically monitor the correct coupling of the plug connector with a suitable counter connector.

BACKGROUND OF THE INVENTION

Passenger cars have nowadays a number of safety restraint systems, such as seat belts pretensions or airbags, as e.g. front and side airbags, which serve to cushion or limit the impact of a passenger with for example interior parts of passenger cars in case of an accident. Deceleration sensors in the passenger vehicle detect high deceleration values as they occur in case of an accident and send a trigger signal via wire or cable to the safety restraints system. An explosive device, known as squib, inflates the airbag or tightens the belt. The wires or cables of the deceleration sensor are connected to an electronic controlled unit and then to a squib, by means of a so called squib connector.

To this day, the squib is usually provided with a socket or receptacle which contains two contact pins. The squib connector includes a plug part or a plug connector corresponding to the socket, which plug part has two receptacles for the reception of the contact pins of the squib socket. To improve the connection between the squib and the plug connector, retainer inserts were developed, which are configured to fit into the receptacle of standardized squibs and which facilitate and secure the connection between the squib and the plug connector. Alternatively to the use of retainers, connector position assurance members, better known as CPA members, were developed, that are mated with the plug connector after the plug connector is coupled to a corresponding counter connector. Such a CPA member is designed, so that a mating to the plug connector is only possible, if the plug connector is correctly coupled to the corresponding counter connector, i.e. the CPA member cannot be mated to the plug connector, if the plug connector is in an uncoupled or incorrectly coupled condition.

The principle structure of an (airbag) squib is for example described in International Patent Publication No. WO 2004/020933. The squib described in this document includes an outer can enclosing a suitable pyrotechnic charge and an ignitor which is provided with two contact pins being electrically connected to an ignitor wire which can activate the charge of the squib. The ignitor further encloses a retainer for securing the squib to the housing of e.g. an airbag inflator, which retainer further includes a plastic insert, which is injection molded around the pins of the squib and which serves to provide for mechanical fastening with the corresponding (squib) plug connector. The retainer is further provided with a so called shorting clip, which is usually an electro conductive metallic spring part, which in the non-coupled condition electrically connects the two pins of the squib with each other, i.e. shorting the same.

The shorting of the contact pins serves to prevent an unintended explosion of the pyrotechnic charge due to electrical potential differences occurring between the two contact pins, for example during transport or handling. The shorting circuit established by the shorting clip is separated and opens upon correct coupling of the corresponding plug connector into or with the retainer, respectively the corresponding counter connector. Alternatively, the shorting clip can be opened by a CPA member. Usually a contact pin member of a shorting clip is displaced by a plug part of the plug connector so that the two contact pins are no longer electrically connected. These shorting clips of the prior art are not only intended to prevent an unintentional ignition of the charge of the squib, but they also serve as a control or monitoring means of the correct coupling of the (squib) plug connector with its counterpart, i.e. the squib receptacle respectively the retainer or insert mounted therein. Upon correct coupling of the plug connector with its counterpart, the short circuit between the contact pins of the squib is automatically opened as described above, and this can be detected by means of suitable electrical/electronic monitoring means, as it is well known to the skilled person.

In the latest developments, modern squibs are so reliable that a shorting clip is no longer absolutely necessary. Thanks to these improvements, an unintended ignition of the charge due to an electrical potential difference between the contact pins can be ruled out. Thus, for this new type of squib, the shorting clips could be disposed of, thereby reducing the manufacturing costs for the squib connectors considerably. However, the shorting clip is not only a safety feature for an unintended ignition of explosive charge of the airbag or belt pretension system but it is also commonly used to monitor the correct coupling of the plug connector with its counterpart.

International Patent Publication No. WO 2010/143078 discloses a squib connector that allows the electrical monitoring of the correct coupling of the plug connector. Therefore, the terminals of the connector are in electrical contact with each other in the uncoupled or incorrectly coupled condition of the plug connector. This electrical contact between the terminals is configured for being separated upon correct coupling to a corresponding counter connector either automatically, i.e. by a retainer or by an actuating action, such as a mating a CPA member. Thus, disconnecting of the terminals can be monitored by a suitable monitoring means. The electrical contact between the terminals is established by contact means, which are provided with one bendable contact tongue. This bendable tongue is bent out of contact upon correct coupling of the plug connector by e.g. separator.

The separator is an electrical insulator and preferably formed of plastic. The contact surfaces of the shorting clip provided in the plug connector are typically in contact with the separator. Due to the contact, of plastic and metallic surface of the shorting clip, the contact surface of the shorting clip can be contaminated with wear debris of the separator. In particular due to relatively high operation temperatures, typically up to 130° C., the contact surfaces of the shorting clip can be unintentionally coated with residual layers of plastic. This effect is known as fogging. In case of disassembling of the electrical plug connector and a new coupling to a corresponding counter connector, the monitoring function can be distorted due to the residual layers disposed on the contact surfaces of the shorting clip. Further residual layers may derive from the oxidation of the surfaces during the lifespan of the shorting clip. Thus, to avoid the building of residual layers, the contact surfaces are typically coated with e.g. a gold coating. This gold coating obviously increases production costs.

A connector for a safety restraint system which allows the electrical or electronic monitoring of the correct coupling of a (squib) plug connector with its corresponding counterpart, for example a squib receptacle or a retainer insert for a squib receptacle, which is cheaper to produce than the known connectors remains desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

An electrical plug connector for a safety restraint system, preferably for an airbag ignition system, is provided that includes at least two contact terminals assigned to the plug connector and a shorting clip that is configured to short circuit the at least two contact terminals in an uncoupled or incorrectly coupled condition of the plug connector, wherein the shorting clip includes at least two contact blades, wherein each contact blade is electrically connected with a respective one of the at least two contact terminals, and wherein each of the contact blades includes at least one cutting edge, which cutting edges contact each other, such that one edge cuts the other, when the plug connector is in an uncoupled or incorrectly coupled condition.

The shorting clip allows, since it has at least two conditions i.e. a short circuit condition and an open/separated condition, to electrically or electronically monitor the coupling of the plug connector to a corresponding counter connector. It should be noted that the term "electrical or electronic monitoring" as used herein, is intended to describe all kinds of monitoring action which may make use of electrical signals. Further, it should be noted that the term "terminals" as used herein describes all parts associated with the terminals, which are arranged inside or close to the housing of the plug connector. In other words, also parts of the electrical signal lines are considered as being members of the terminals, as long as they are arranged inside or close to the plug connector housing.

The contact blades, which are electrically connected with a respective one of the at least two contact terminals, allow the short circuiting of the terminals. A contact blade and a respective one of the at least two contact terminals can be integrally formed as one part or can be formed as a separate parts. In the second case, i.e. in the case of separate parts, the contact blade and the contact terminal have to be electrically connected for example by welding, soldering or by a wired line.

The cutting edges of the contact blades are preferably sharp edges. At least one of the cutting edges, preferably both, include an included angle of less than 90°, more preferable an included angle of less than 70° and even more preferable an included angle of less than 60°. As it is known from knife geometry, the edge angle of a blade is the angle between the blade center and the blade side surface, whereas the included angle is the angle between both blade sides, i.e. formed by the two adjacent surfaces of the blade that form the edge. It has to be noted, that the cutting edge can alternatively be provided with a radius or a phase. These cutting edges allow a relatively small contact area, compared to conventional shorting clips having e.g. contact tongues, since the cutting edges are arranged such that one edge cuts the other. The term "cutting" has to be understood as abutting the edges across each other, wherein preferably a microscopic cut or notch is driven into at least one of the cutting edges. This cutting improves the electrical contact between the contact blades, since the electrical resistance of the contact can be reduced, e.g. by cutting through residual layers of plastic, oxides or the like. Further, the relatively small contact area leads to an increase in contact pressure under constant contact force. A contact force is e.g. applied due to the preload of the contact blades that are preferably formed as preloaded springs.

Preferably, at least one of the two contact blades includes a bendable portion, which bendable portion is bent to separate the contact between the cutting edges of the blades upon correct coupling of the plug connector. In particular, one bendable portion is sufficient to opened the contact between the cutting edges in order to monitor the correct coupling of the plug connector. The correct coupling of the plug connector occurs, if the plug connector is coupled mechanically correct to the corresponding counter connector. This mechanically correct coupling is achieved by the design of the plug connector and the corresponding counter connector, i.e. the bendable portion is bent to separate the contact between the cutting edges only if the coupling of the plug connector to the corresponding counter connector is correctly completed.

The separation of the contact between the cutting edges can be achieved automatically or manually. An automatic separation is preferably achieved by a part of the counter connector, which disconnects (separates) the contact upon full insertion of the plug connector. Alternatively, it is also possible that a manual or automated actuating action is necessary to disconnect (separate) the contact. This is preferably achieved by the insertion of a connector positioning assurance (CPA) member, which can only be fully inserted into the plug connector upon correct coupling of the plug connector to the corresponding counter connector. Then, the CPA member mechanically disconnects (separates) the electrical contact between the terminals.

Thus, preferably, the electrical plug further includes a connector position assurance CPA member, which is insertable into a housing of the plug connector and which upon full insertion into the housing of plug connector separates the contact between the at least two cutting edges of the contact blades. Providing a CPA member, that is insertable into a housing, only if the plug connector and the corresponding counter connector are coupled correctly to each other and that separates the contact between the at least two cutting edges, allows an electrical or electronic monitoring of the plugging.

Alternatively and preferably, the contact between the at least two cutting edges of the contact blades is configured to be separated upon correct coupling to a corresponding counter connector of the plug connector, due to a mechanical contact with a separator of the counter connector. This allows an automated separation of the contact between the cutting edges. Therefore, the plugging of the plug connector is facilitated, and no additional parts, such as a CPA member, are necessary. Preferably, the cutting edges of the at least two contact blades do not contact any structure of the plug connector, if the plug connector is correctly coupled to a corresponding counter connector. Being out of contact with any structure of plug connector, the contact blades are less prone to fogging. Fogging means the unintended deposition of material, such as plastic material from a member that is in contact with the contact blades. This member can for example be a separator that is e.g. part of the CPA member or a corresponding retainer, and that is used to separate the contact between the cutting edges. The non-contact condition can for example be achieved, by providing the separator with corresponding recesses or by designing the separator, such that the separator separates the contact by contacting an area that is different from the cutting edge of the contact blades.

Preferably, the cutting edges of the at least two contact blades are punched edges, having preferably at least one punching burr. Punched edges, having preferably the punching burr provide sharp edges that allow very small contact areas. Thus the contact pressure can be significantly increased under constant contact force. Further, the cutting can be improved, so that the electrical resistance of the contact can be reduced. Further, by applying high contact pressures, the electrical contact is less prone to being separated by vibrations or the like. Preferably, the contact area of the contact between the at least two edges is smaller than 1 $mm^2$, preferably smaller than 0.5 $mm^2$ and most preferably smaller than 0.1 $mm^2$. These contact areas have shown two provide an increased contact condition between the cutting edges.

Preferably, at least one terminal and the respective contact blade are integrally formed as one part and even more preferably each contact blade is integrally formed with a respective one of the at least two contact terminals, wherein the integrally formed part is preferably made of a copper alloy. By integrally forming the terminal and the respective contact blade, manufacturing costs can be reduced and the number of parts to be handled during the assembly of the connector can be reduced. Thus, costs can be effectively minimized. Further, a copper alloy provides good electrical properties and a rigidity that allows the cutting of the cutting edges.

Preferably, the contact blades are not gold plated. Due to the geometry of the cutting edges, a plating, such as gold plating is no longer necessary, since the cutting edges are less prone to residual layers, as described above, and the contact pressure between the cutting plates is significantly increased.

Preferably, the cutting edges of the at least two contact blades are configured to execute a relative cutting movement to each other, during establishing the electrical contact between the cutting edges. This cutting movement results in that one cutting edge scratches over the other cutting edge, so that possible contaminants or residual layers can be removed. Thus, the electrical contact and in particular the electrical conductivity of the contact can be increased and the electrical resistance of the contact can be reduced. Preferably, the cutting edges of the at least two contact blades are configured to at least partly remove residual layers deposited on the cutting edges, in order to improve the electrical contact.

The residual layers to be removed may include oxide layers, deposited contaminants and/or fogged plastic. Oxidation typically occurs during the use of the plug connector. Particularly in vehicles, high operating temperatures can occur. Thus, non-protected surfaces of the terminals or contact blades are prone to oxidation. Other contaminants may arise from corrosion or dust being present in the working environment. By at least partly removing these residual layers, the contact area can be at least partly cleaned, wherein the electrical conductivity of the contact is increased.

A method for assembling an electrical connector assembly is also provided. The method includes the steps of providing a plug connector as described above, providing a corresponding counter connector and mating the plug connector with the corresponding counter connector, wherein the contact between the at least two cutting edges of the contact blades of the plug connector is separated upon correct coupling of the plug connector to the corresponding counter connector. The separation of the contact between the at least two cutting edges, allows the electrical or electronic monitoring of the plug condition. If the connector is mated correctly, the terminals are no longer short circuited, so that on the one hand the monitoring is possible and on the second hand, the safety restraint system is unlocked, since the pins of the restraint system, as described before, are no longer shorted via the terminals and the shorting clips.

Preferably, the method further includes the steps of providing a connector position assurance (CPA) member and inserting the connector position assurance member into a housing of the plug connector in order to separate the contact between the at least two cutting edges of the contact blades, upon full insertion of the connector position assurance member into the housing of the plug connector. Providing a connector position assurance member allows the manual separation of the contact between the at least two cutting edges. The CPA member therefore is inserted into the housing after the plug connector is plugged to the corresponding counter connector. This can preferably be achieved in one plugging movement. However, the insertion of the CPA member is preferably only possible, if the plug connector is mated correctly. Thereby, the separator separates the contact between the cutting edges.

Preferably, the method further includes separating the contact between the at least two cutting edges of the contact blades upon correct coupling of the plug connector to a corresponding counter connector due to a mechanical contact with a separator of the counter connector. If the separator is provided within the counter connector, such as a retainer, the separation of the contact between the cutting edges can be achieved automatically. Thus no further manual insertion of an additional member, such as a CPA member, is necessary.

The object is further solved by an electrical connector system including a plug connector and a corresponding counter connector, wherein the plug connector includes a shorting clip as described above. This electrical connector system allows the monitoring of the correct coupled condition of the corresponding counter connector and the plug connector and further the short circuiting of the terminals of the plug connector.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
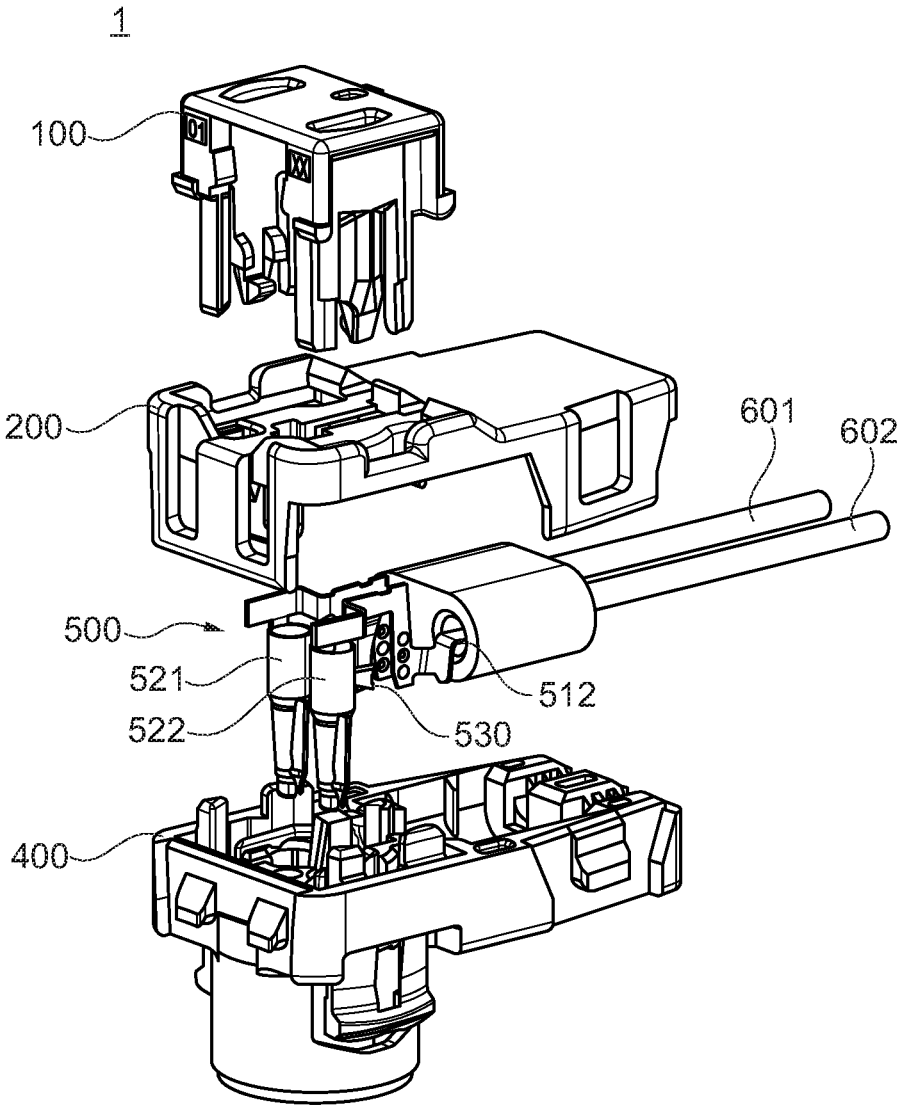
FIG. 1 shows a schematic illustration of a plug connector in an exploded view.

FIG. 1 shows a non-limiting example of an electrical plug connector, hereinafter referred to the plug connector 1 for a safety restraint system, preferably for an airbag ignition system. The plug connector 1 includes a housing, wherein the housing includes at least two parts, a main part 400 and a cover 200. The cover 200 is configured to receive a terminal assembly 500, including at least 2 terminals 521, 522. The two terminals 521, 522 are configured to be connected with corresponding pins of a corresponding counter connector. The terminal assembly 500 further includes a shorting clip 530. The shorting clip 530 is configured to short circuit the at least two contact terminals 521, 522 in an uncoupled or an incorrectly coupled condition of the plug connector. Further, a welding or soldering member 511, 512 is configured to be welded or soldered to a corresponding signal line 601, 602. Other suitable electrically conductive connecting methods are also possible. Further, the plug connector 1 includes a connector position assurance (CPA) member 100 which is insertable into the housing 200, 400 of plug connector 1. The CPA member 100 will upon full insertion into the housing 200, 400 of the plug connector 1 separate the contact between the at least two cutting edges (not shown in FIG. 1) of the shorting clip 530.

Figure 2A:
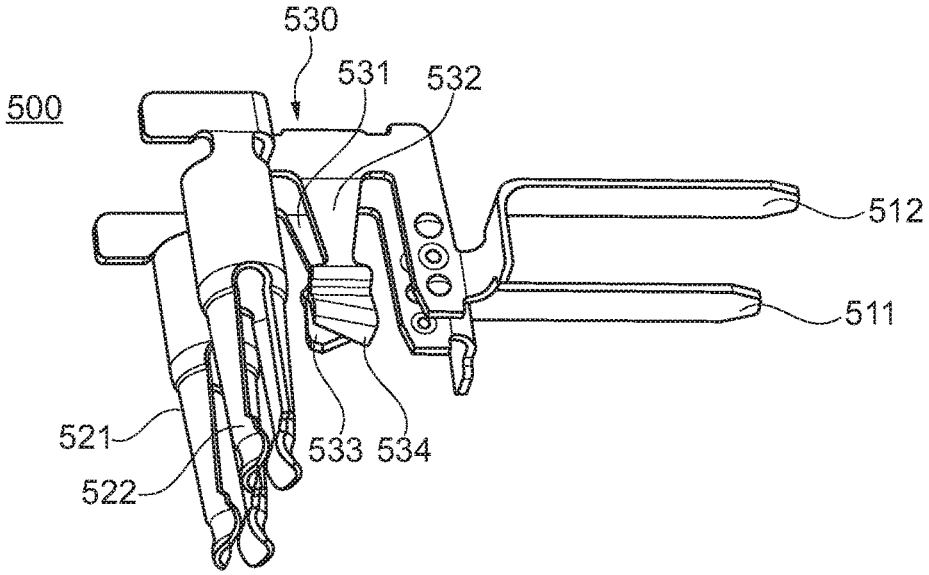
FIGS. 2A-D show a schematic illustration of a terminal assembly, including a shorting clip.

FIGS. 2A to 2D show the terminal assembly 500 in greater detail. Thereby FIG. 2A shows the terminal assembly 500 including two terminals 521 and 522, which are configured to be connected to corresponding pins of a counter connector. Further, each of the terminals 521, 522 is assigned to a respective contact blade 533, 534. These contact blades 533, 534 include a bendable portion 531, 532 which bendable portion 531, 532 is bent to separate the contact between the cutting edges 535, 536. The cutting edges 535, 536 are shown in greater detail in FIG. 2C. Still further, each terminal is assigned with a respective welding or soldering member 511, 512. As can be seen, the contact terminal and the corresponding contact blade 533, 534 are integrally formed as one part. Preferably, they are formed from a single metal sheet for example by punching, embossing, and other suitable sheet forming techniques.

Figure 2B:
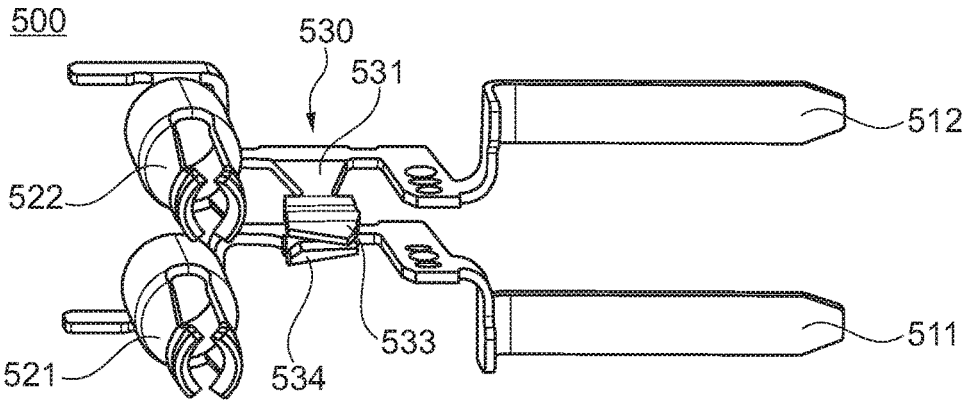
Figure 2C:
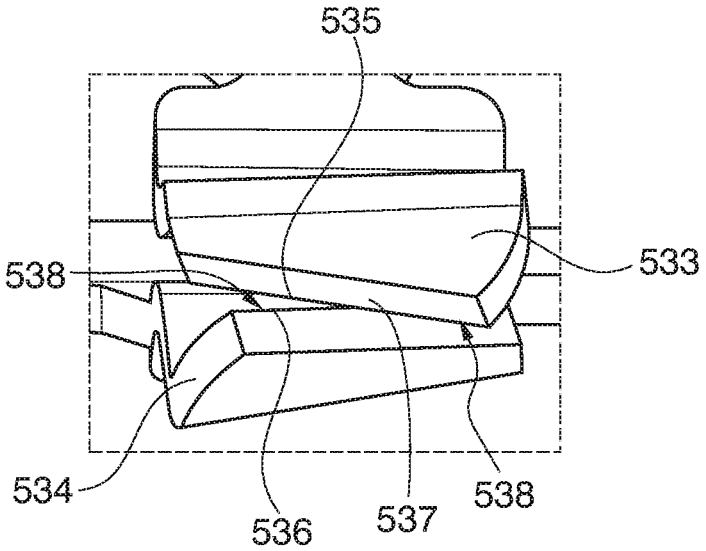
Figure 2D:
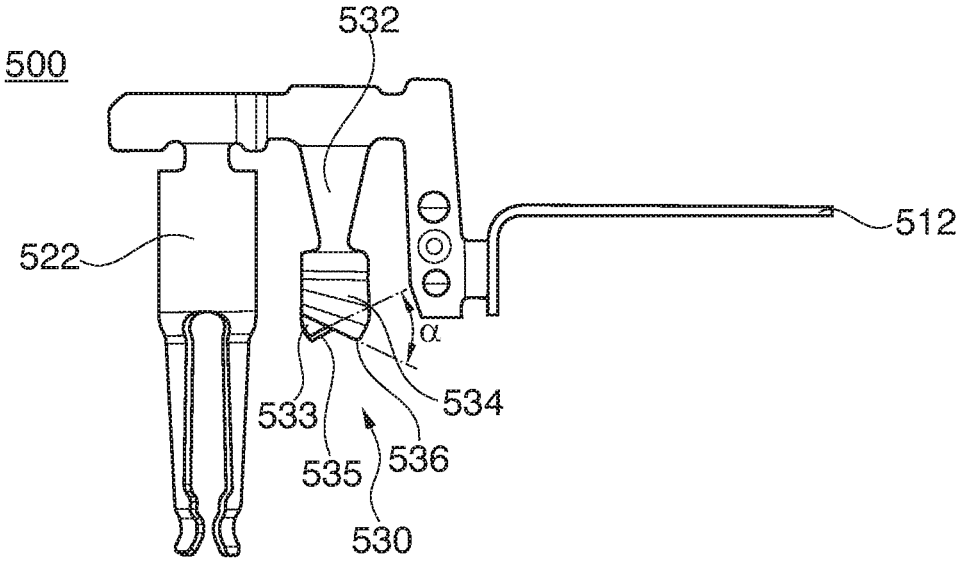

FIG. 2B shows the terminal assembly 500 of FIG. 2A from a different view. In particular, the terminal assembly is shown with view on the contact blades 533, 534. Further, FIG. 2C shows a detailed enlarged view of the contact blades 533, 534 of FIG. 2B. As can be best seen in FIG. 2C, each contact blade 533, 534 include at least one cutting edge 535, 536. These cutting edges 535, 536 contact each other such that one edge cuts the other in the contact area 537. The cutting edges are preferably sharp edges and most preferably punching edges, having a punching burr 538. Thus, the contact area 537 can be significantly reduced and the contact pressure is increased under constant contact force. Further, due to the cutting of the cutting edges with one another, residual layers such as oxide layers, fogged plastic layers or contaminant layers or the like can be cut. FIG. 2D shows the terminal assembly 500 in a side view. In particular, the contact blades 533 and 534 of the shorting clip 530 are shown. As can be seen, the cutting edges 535, 536 of the contact blades 533, 534 enclose an angle $\alpha$ which is different from 0 and 180°, so that one edge cuts the other.

Figure 3A:
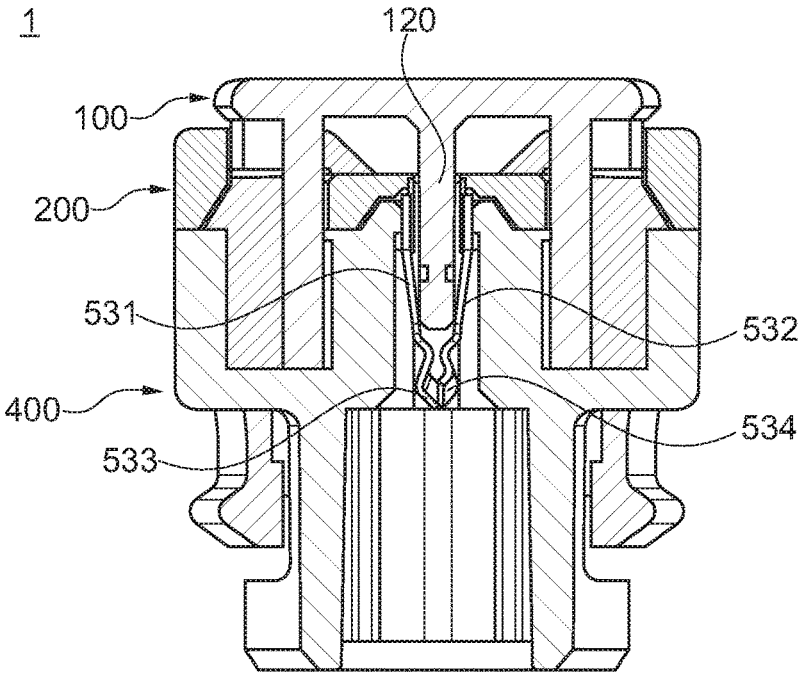
FIGS. 3A-3B show a schematic cut view of an electrical plug connector including a CPA member in an uncoupled and a correctly coupled condition.

FIG. 3A shows the plug connector 1 in a cut view, wherein the plug connector 1 is in an uncoupled condition. The cover 200 and main part 400 of the housing of the plug connector 1 are engaged with each other. A connector position assurance member (CPA) member 100 is installed within the housing 200, 400. A separator 120 of the CPA member 100 is arranged between the contact blades 533, 534. The cutting edges of the contact blades 533, 534 are in contact with each other in the shown uncoupled condition of the plug connector 1. The contact blades 533, 534 include a bendable portion 531, 532, which bendable portion is bent outwardly if the CPA member 100 is inserted fully into the housing 200, 400 of the plug connector 1. Thereby, the contact between the cutting edges is opened by the separator 120.

Figure 3B:
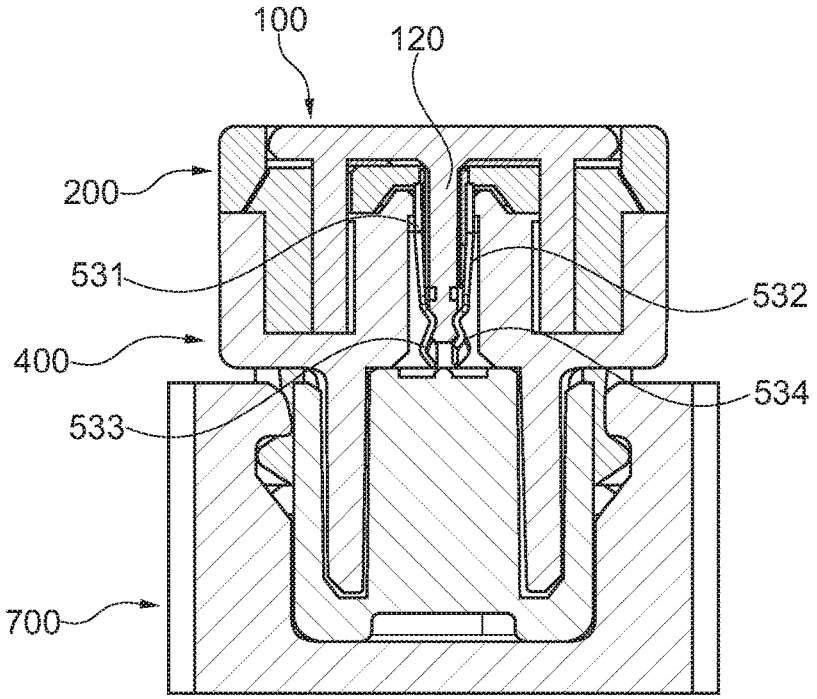

This coupled condition can be seen in FIG. 3B. As shown in FIG. 3B, the CPA member 100 is fully inserted into the housing 200, 400 and the plug connector 1 is correctly coupled to a corresponding counter connector 700. By contacting and bending the contact blades 533, 534 by the separator 120 of the CPA member 100, the electrical contact between the cutting edges of the contact blades 533, 534 is opened. Since the CPA member 100 is only insertable if the plug connector 1 is correctly coupled to the corresponding counter connector 700, the shorting clip 530 and in particular the contact between the cutting edges can be used for electrical or electronic monitoring the coupling condition.

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical plug connector, comprising:

at least two contact terminals assigned to the plug connector; and a shorting clip that is configured to short-circuit the at least two contact terminals in an uncoupled or incorrectly coupled condition of the plug connector, wherein the shorting clip has two contact blades, wherein each contact blade is electrically connected with one of the at least two contact terminals, wherein each contact blade has a cutting edge, and wherein the cutting edges contact each other, such that one cutting edge cuts the other when the plug connector is in in an uncoupled or incorrectly coupled condition.

2. The electrical plug connector according to claim 1, wherein at least one of the two contact blades has a bendable portion, wherein the bendable portion is bent to separate contact between the cutting edges of the two contact blades upon correct coupling of the plug connector.

3. The electrical plug connector according to claim 1, further comprising a connector position assurance (CPA) member, wherein the CPA member is insertable into a housing of the plug connector and wherein upon full insertion into the housing of the plug connector the CPA member separates contact between the at least two cutting edges of the two contact blades.

4. The electrical plug connector according to claim 1, wherein contact between the at least two cutting edges of the two contact blades is configured to be separated upon correct coupling to a corresponding counter connector of the plug connector due to a mechanical contact with a separator of the counter connector.

5. The electrical plug connector according to claim 1, wherein the cutting edges of the at least two contact blades do not contact any structure of the plug connector if the plug connector is correctly coupled to a corresponding counter connector.

6. The electrical plug connector according to claim 1, wherein the cutting edges of the at least two contact blades are punched edges having a punching burr.

7. The electrical plug connector according to claim 1, wherein a contact area of a contact between the at least two cutting edges is smaller than 1 $mm^2$.

8. The electrical plug connector according to claim 1, wherein at least one terminal and at least one contact blade are integrally formed as one part and wherein each contact blade is integrally formed with a respective one of the at least two contact terminals.

9. The electrical plug connector according to claim 1, wherein the two contact blades are not gold plated.

10. The electrical plug connector according to claim 1, wherein the cutting edges of the at least two contact blades are configured to execute a relative cutting movement to each other while establishing electrical contact between the cutting edges.

11. The electrical plug connector according to claim 1, wherein the cutting edges of the at least two contact blades are configured to at least partly remove residual layers deposited on the cutting edges in order to improve electrical contact and wherein the residual layers to be removed may include oxide layers, deposited contaminants, and/or fogged plastic.

12. The electrical plug connector according to claim 1, wherein at least one of the cutting edges have an included angle of less than 90°.

13. A method of assembling an electrical connector assembly, comprising the steps of:

providing a plug connector including at least two contact terminals assigned to the plug connector and a shorting clip configured to short-circuit the at least two contact terminals in an uncoupled or incorrectly coupled condition of the plug connector, wherein the shorting clip further includes at least two contact blades, wherein each contact blade is electrically connected with a respective one of the at least two contact terminals, and wherein each of the contact blades includes at least one cutting edge, which cutting edges contact each other, such that one edge cuts the other, when the plug connector is in in an uncoupled or incorrectly coupled condition;

providing a corresponding counter connector; and mating the plug connector with the corresponding counter connector, wherein contact between the at least two the cutting edges of the contact blades of the plug connector is separated upon correct coupling the plug connector to the corresponding counter connector.

14. The method according to claim 13, further comprising the steps of:

providing a connector position assurance (CPA) member; and inserting the CPA member into a housing of the plug connector in order to separate the contact between the at least two cutting edges of the two contact blades upon full insertion of the CPA member into the housing of the plug connector.

15. The method according to claim 13, further comprising the step of separating the contact between the at least two cutting edges of the two contact blades upon correct coupling the plug connector to a corresponding counter connector due to a mechanical contact with a separator of the counter connector.

* * * * *